United States Patent [19]

Freeman

[11] 4,452,381

[45] Jun. 5, 1984

[54] BEVERAGE DISPENSING SYSTEM

[75] Inventor: Bruce A. Freeman, Oklahoma City, Okla.

[73] Assignee: Continental Plastics Company, Oklahoma City, Okla.

[21] Appl. No.: 362,981

[22] Filed: Mar. 29, 1982

[51] Int. Cl.[3] ..... B67D 3/00

[52] U.S. Cl. ..... 222/465 R; 222/478; 222/566; 220/83; 220/DIG. 13

[58] Field of Search ..... 222/566, 567, 569, 570, 222/478, 513, 479, 572, 465, 475; 220/83, DIG. 13; 215/320, 224

[56] References Cited

U.S. PATENT DOCUMENTS

| | | | |
|---|---|---|---|
| 1,282,103 | 10/1918 | Moffat | 222/566 |
| 1,436,708 | 11/1922 | Goebel . | |
| 1,509,360 | 9/1924 | Lewis | 222/478 |
| 1,549,858 | 8/1925 | Evans | 222/568 |
| 2,387,092 | 10/1945 | Schlumbohm | 222/475 |
| 2,545,350 | 9/1949 | Fuld . | |
| 2,690,852 | 7/1951 | Schuler . | |
| 2,732,108 | 12/1952 | Haddad . | |
| 3,081,008 | 3/1963 | Hester | 222/478 X |
| 3,126,139 | 3/1964 | Schechter | 220/83 X |
| 3,338,482 | 5/1965 | Jordan . | |
| 3,430,826 | 10/1967 | Microulis . | |
| 3,523,368 | 8/1970 | Hammond | 222/46 S X |

OTHER PUBLICATIONS

Brochure Entitled "Introducing The Marcos Store N' Pour Juicer", Distributed by Marcos Corporation.

*Primary Examiner*—Joseph J. Rolla
*Assistant Examiner*—Kevin P. Shaver
*Attorney, Agent, or Firm*—William R. Laney

[57] ABSTRACT

This invention relates to a beverage dispensing system which includes a base container, an elongated discharge neck detachably connectable to the base container and a pouring spout or nozzle which is provided for snap engaging the open outer end of the neck. The nozzle or spout includes a liquid discharge channel and an air vent channel positioned in close proximity to the liquid discharge channel and extending substantially parallel thereto.

1 Claim, 4 Drawing Figures

BEVERAGE DISPENSING SYSTEM

BACKGROUND OF THE INVENTION

1. Field of the Invention

This invention relates to beverage dispensing systems and devices which can be used for manually pouring a beverage from a storage container into a shot glass, tumbler or other receptacle, using one hand to lift and pour the beverage during dispensation.

2. Brief Description of the Prior Art

Many devices have been heretofore proposed for gravity pouring a small amount of liquid from a storage container by the use of a nozzle having a restricted liquid discharge passage therein. It has further been proposed to mount such a nozzle at one end of an elongated neck. The neck is joined at its other end to a relatively large container in which a substantial volume of the liquid to be dispensed is stored. This type of structure has been used for dispensing alcoholic beverages in bars where the bartender grips the elongated neck in one hand, lifts the dispensing system, tilts it, and discharges the beverage through the nozzle into a shot glass, tumbler or the like.

Several criteria are important in the design of a beverage dispensing system of this general type. First, it is important that the beverage dispensing system be able to withstand relatively rough handling because frequently the bartender must move quickly in lifting the dispensing system, using it for dispensing the liquid contents thereof and then setting it down quickly at some location among a number of other bottles and similar beverage dispensing systems. The bartender must be able to attain a sure grip on the neck of the container or some other part of it, and his rapid movements in tilting the container must not cause some of the liquid to slosh in a misdirected fashion so as to fall upon the customer or upon the bar. It is also important that dispensing systems of this type be sanitary in usage and be susceptible to repeated cleaning. Preferably, the re-utilization of the system after the contents thereof have been entirely dispensed can be effected without violation of any sanitation laws.

A number of beverage dispensing systems of the type described have been heretofore proposed. Examples of such systems are the systems which are shown in Goebel U.S. Pat. No. 1,436,708; Schuler U.S. Pat. No. 2,690,852; Microulis U.S. Pat. No. 3,430,826; Fuld U.S. Pat. No. 2,545,350 and Haddad U.S. Pat. No. 2,732,108. Another patent which depicts a beverage dispensing system of the general type described is shown in Jordan U.S. Pat. No. 3,338,482. Another type of beverage dispensing system generally similar to those shown in the foregoing patents, and including a base container, elongated neck and nozzle is that which has, until recently, been marketed by the Marcos Corporation of Manchester Center, Vermont.

An aspect which commonly characterizes systems of the type described is that in order to permit the liquid contents of the system to pass through the neck and out through the nozzle without interruption of flow due to air venting, an air vent passageway is provided which extends substantially parallel to the axis of the container and nozzle, and opens at a location which is spaced away from the opening through which the liquid is discharged. With this type of arrangement, rapid use of the system can easily cause a part of the liquid contents of the system to be discharged out of the air vent channel or orifice, and in a direction such that it does not enter the shot glass, tumbler or other receptacle into which the liquid is to be directed. Instead, the liquid which is thus sloshed out of the air channel or vent may splatter on a customer, on the bartender or on the bar itself. Whatever the ultimate repository of the errant liquid content of the container, such construction is undesirable because of this lack of control.

Typical of those beverage dispensing systems which are characterized by the described problem of the liquid contents of the system passing out through the air vent channel are the systems which are illustrated in Fuld U.S. Pat. No. 2,545,350, in Haddad U.S. Pat. No. 2,732,108 and in Goebel U.S. Pat. No. 1,436,708. The beverage dispensing system sold by the Marcos Corporation under the name STOR 'N POUR also has its air vent or channel located in the described orientation with respect to the liquid discharged channel.

BRIEF DESCRIPTION OF THE PRESENT INVENTION

The present invention provides an improved liquid dispensing system which is particularly suited for storing and quickly dispensing into a glass, tumbler or the like, liquids or semi-liquid materials. The system is basically one of three parts in which a base container serves as the main storage reservoir and communicates at its open upper end with an elongated tapered discharge neck which can be quickly engaged with or detached from, the base container. At the relatively small diameter end of the neck opposite its base connected to the base container, the neck carries a pouring spout or nozzle which extends at an acute angle to the axis of the neck, and is quick detachably connected to the neck. The pouring spout or nozzle includes a relatively large main liquid dischage channel which opens into the neck, and the nozzle also defines an air vent channel which is in close proximity, and extends substantially parallel, to the main liquid discharge channel and also opens into the neck.

The described liquid dispensing system, by reason of the neck configuration, can be quickly and easily gripped in one hand and inverted to a position where the liquid contents of the base container will discharge quickly and easily through the liquid discharge channel of the nozzle. The air vent channel, while functioning to permit air to enter the neck and the base container to replace liquid being discharged therefrom is constructed and is located so that any liquid which may pass into the air vent channel is also directed into the glass, tumbler or other receptacle into which the liquid is being discharged.

The described construction thus provides a liquid dispensing system which is relatively more sanitary and cleaner to use, in that inadvertent spillage of liquid is more certainly avoided.

Another object of the invention is to provide a liquid dispensing system which is light in weight and can be handled and manipulated easily and quickly to discharge a liquid carried therein.

Additional objects and advantages will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
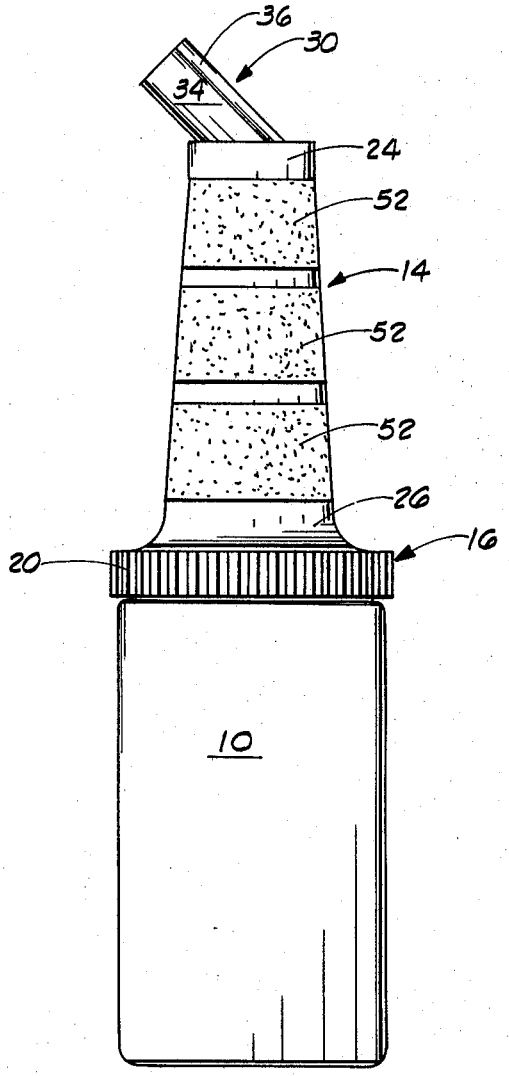
FIG. 1 is a side elevation view of a liquid dispensing system constructed in accordance with the present invention.

The liquid dispensing system of the invention includes a cylindrical base container 10 having a flat bottom and a relatively large opening at the top. In the illustrated embodiment of the invention, the open top of the container 10 is of reduced diameter and carries an external thread 12. The base container 10 is preferably constructed of a flexible synthetic resin material so that if the dispensing system is dropped on a hard surface, it will not break.

An elongated, tapered discharge neck, designated generally by reference numeral 14, is connected to the open, upper end of the base container 10. The discharge neck 14 includes an open, annular base designated generally by reference numeral 16. The open, annular base 16 is of generally cylindrical configuration and carries an internal thread 18 at its inner side and a plurality of parallel ridges or knurls 20 which extend substantially parallel to the axis of the cylindrical base container 10 to facilitate unscrewing the discharge neck from the base container.

Figure 2:
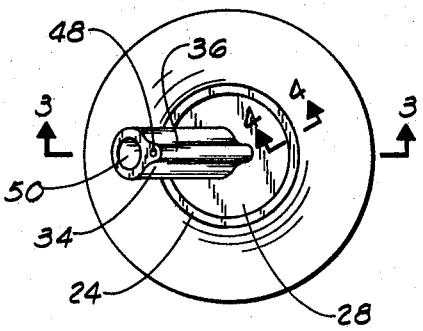
FIG. 2 is a vertical sectional view taken through the center of the liquid dispensing system shown in FIG. 1, and along line 3—3 of FIG. 2.

A major portion of the tapered discharge neck 14 is an elongated tubular hand grip portion 22 which undergoes a reduction in diameter from that portion thereof which is closest to the base 16 to an open, upper end portion 24 thereof. The elongated, tubular hand grip portion 22, at the end thereof near the open, annular base 16 flares outwardly through a generally frustoconical connecting portion 26 which connects the hand grip portion to the annular base. The open, upper end portion 24 of the hand grip portion is of generally cylindrical configuration as shown in FIGS. 1 and 2. The elongated, tapered discharge neck 14 is preferably molded of synthetic resin of the same composition as the base container 10.

Figure 4:
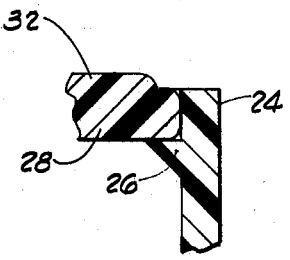
FIG. 4 is a sectional view taken along line 4—4 of FIG. 2.

The open, upper end portion 24 of the hand grip portion of the discharge neck 14 is internally formed so as to provide an annular step 26 of triangular cross section spaced downwardly from the upper end of the neck as shown in FIG. 4. The internal diameter of the open, upper end portion 24 of the discharge neck 14 is such that a tight, frictional snap engagement is provided with a disk-shaped base plate 28 formed at one end of a pouring spout or nozzle designated generally by reference numeral 30.

The pouring spout or nozzle 30 includes a raised circular pad 32 formed on the base plate 28 and an elongated tubular liquid discharge channel 34 of round cross-section, which projects through the pad 32 and the base plate 28 and opens at a location communicating the tubular discharge channel 34 with the opening at the upper end of the elongated tapered discharge neck 14. Immediately adjacent the liquid discharge channel 34 is a tubular air vent channel 36 of round cross-section. The air vent channel 36 extends substantially parallel to the liquid discharge channel 34 and is separated therefrom by a relatively thick wall 38 at one side of the liquid discharge channel. The air vent channel 36 has a semi-cylindrical lip 42 which projects beyond the relatively thick wall 38 between the air vent channel and the liquid discharge channel so as to define a protective pocket or space 44 adjacent one side of the opening at the outer end of the elongated tapered discharge neck 14. This lip diminishes the opportunity for liquid to enter the air vent channel.

Figure 3:
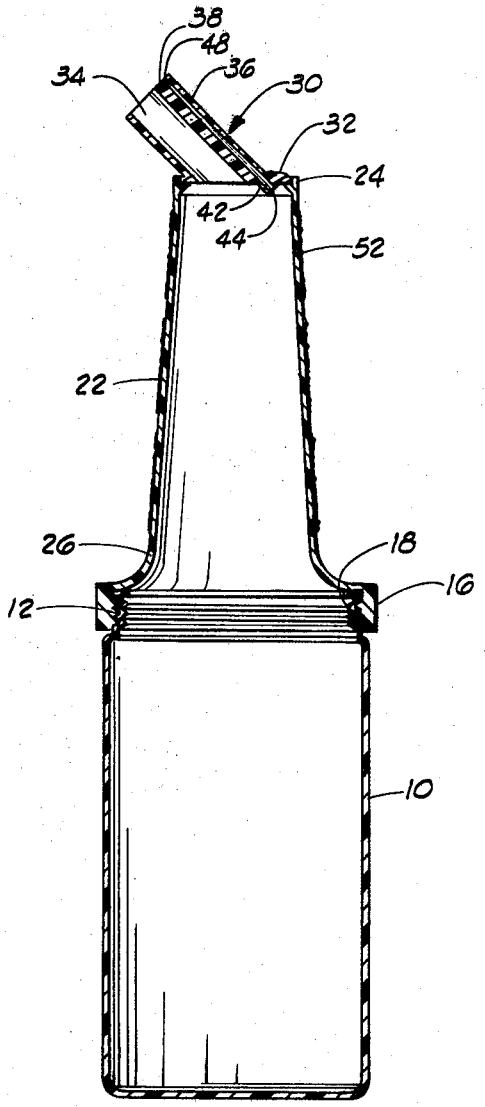
FIG. 3 is a top plan view of the liquid dispensing system of the invention.

It will be noted in referring to FIG. 3 that the air vent channel 36 terminates at an opening 48 at its outer end which is substantially conterminous with an opening 50 at the outer end of the liquid discharge channel 34.

The pouring spout or nozzle 30 is preferably molded of plastic, with each of the structural elements thereof integrally formed. Also, as previously pointed out, the base plate 28 is dimensioned to permit it to be snapped into the annular space which is formed between the upper side of the annular step 26 and the open end of the elongated, tapered discharge neck 14. Preferably, as shown in FIG. 4, the base plate 28 has its outer peripheral edge rounded or radiused to facilitate snapping it into the open upper end of the discharge neck 14.

In order to permit the liquid dispensing system to be more easily and safely utilized, a plurality of roughened or etched areas 52 are provided around the elongated tapered discharge neck 14 on the outer side thereof. This permits the system to be gripped with one hand around the discharge neck, lifted up and tilted so that the liquid contents of the system can be poured out of the liquid discharge channel 34.

An important feature of the invention is the manner in which the air vent channel 36 is constructed, and its position relative to the liquid discharge channel 34. In many prior art types of constructions, the air vent channel is directed substantially parallel to the axis of the elongated neck and base container or, stated differently, at a substantial angle to the axis of the liquid discharge channel. In such cases, hurried usage of the liquid discharge system has frequently resulted in liquid sloshing from the discharge neck into the air vent channel and then spurting from the air vent channel onto a table or onto persons near the container or tumbler into which the liquid contents of the system are being directed. In the present invention, by making the air vent channel extend parallel to the liquid discharge channel, and making the discharge openings of each located in close proximity to each other, little opportunity exists for liquid which may enter the air vent channel to be misdirected or discharged to any other location except into the receiving container or tumbler.

In the utilization of the system of the invention, a liquid in substantial quantity can be stored in the base container 10. This container can be easily filled by simply unscrewing the open annular base 16, located at one end of the discharge neck 14, from the threaded upper end of the base container 10. When the discharge neck is replaced by screwing the annular base back on to the base container, the system is ready for use in the manner hereinbefore described. The three-part assembly making up the system facilitates rapid and easy cleaning and sanitizing of the system, and the all plastic construction assures against breakage should the system be dropped on a hard surface.

Although a preferred embodiment of the invention has been herein illustrated and described, it will be understood that various changes and innovations can be effected in the system without departure from these basic principles and within the spirit and scope of the invention. All such changes and innovations thus continuing to relay on the basic principles of the invention are therefore deemed to be within the spirit and scope of the invention herein described, except as the invention may be necessarily limited by the appended claims or reasonable equivalents thereof.

What is claimed is:

1. A flexible, synthetic resin beverage dispensing system for dispensing a beverage from a storage container into a relatively small shot glass, tumbler or the like, said dispensing system comprising:

a base container of generally cylindrical configuration having a cylindrical upper end portion of lesser diameter than the remainder of the generally cylindrical base container, and defining a generally circular, externally threaded opening into said upper end portion;

an elongated, tubular discharge neck having an open, internally threaded annular base at one end detachably connected to the open upper end portion of the base container, said annular base having parallel ridges disposed peripherally around the external surface thereof and each extending substantially parallel to the axis on the cylindrical base container to facilitate gripping the discharge neck for unthreading the discharge neck from the cylindrical base container and further affording freedom from the lodging of contaminants between such parallel ridges, said discharge neck further having a second end opposite said one end, and having an elongated tubular hand grip portion tapering from a relatively large diameter end to a relatively small diameter end, said discharge neck further including, an open, cylindrical end portion forming said small diameter end;

roughened areas around the outer side of said tubular hand grip portion between the ends thereof formed by roughening the synthetic resin at said roughened areas;

an annular step of triangular cross-section extending around the inner side of the small diameter end portion of said elongated tubular hand grip portion at a location spaced inwardly from the opening thereinto; and an outwardly flaring frust-conical connecting portion connecting said large diameter end of said hand grip portion to said internally threaded annular base; and a synthetic resin pouring spout snap-detachably connected to said small diameter end portion and angularly inclined at an acute angle with respect to the longitudinal axis of said elongated tubular discharge neck, said synthetic resin pouring spout including:

a disc-shaped base plate pressed into said small diameter end portion of said tubular hand grip portion and including a peripheral area which snap-engages the open, cylindrical end portion forming said small diameter end of said elongated tubular hand grip portion of said tubular neck;

a raised circular pad formed on the base plate on its side opposite the side facing the interior of the elongated tubular discharge neck and reinforcing the central portion of the base plate within the peripheral portion of the base plate which yieldingly snap-engages the open cylindrical end portion forming the small diameter end of said elongated tubular hand grip portion of said tubular neck;

a liquid discharge channel of circular cross-section providing a passageway for liquid from the discharge neck to a discharge channel opening at one end of the liquid discharge channel in said pouring spout;

an air vent channel positioned immediately adjacent, and extending parallel to, the liquid discharge channel, and having an air vent channel opening adjacent said discharge channel opening located at one end of the discharge channel whereby any liquid from the base container and tubular discharge neck entering said air vent channel is discharged through said air vent channel opening adjacent the discharge channel opening located at one end of the liquid discharge channel and in the same direction as liquid discharged through said liquid discharge channel, said air vent channel having a greater length from one end thereof to the other than said liquid discharge channel, and isolated over its length from communication with said liquid discharge channel, to thereby avoid obstructing the air vent channel with liquid flowing through said liquid discharge channel; and a semi-cylindrical lip projecting from the end of the spout engaged with said tubular hand grip portion of the discharge neck, said semi-cylindrical lip defining a protective pocket diminishing the entry of liquid from the discharge neck into the air vent channel, said semi-cylindrical lip projecting past said base plate into said discharge neck.

* * * * *